United States Patent [19]

Welland

[11] 4,454,433

[45] Jun. 12, 1984

[54] MULTIPLIER CIRCUIT

[75] Inventor: David R. Welland, Boston, Mass.

[73] Assignee: DBX, Inc., Newton, Mass.

[21] Appl. No.: 293,470

[22] Filed: Aug. 17, 1981

[51] Int. Cl.[3] ..... G06G 7/12; G06G 7/24; H03G 3/20; H03G 3/30

[52] U.S. Cl. ..... 307/493; 307/491; 307/492; 328/145; 330/278

[58] Field of Search ..... 307/491, 492, 493, 500; 328/145; 330/278

[56] References Cited

U.S. PATENT DOCUMENTS

| | | | |
|---|---|---|---|
| 3,714,462 | 1/1973 | Blackmer | 307/492 |
| 4,225,794 | 9/1980 | Buff | 328/145 |
| 4,234,804 | 11/1980 | Bergstrom | 307/493 |
| 4,331,931 | 5/1982 | Adams | 307/493 |
| 4,341,962 | 7/1982 | Buff | 307/493 |
| 4,403,199 | 9/1983 | Blackmer | 307/493 |

*Primary Examiner*—John S. Heyman

*Assistant Examiner*—Timothy P. Callahan

*Attorney, Agent, or Firm*—Schiller & Pandiscio

[57] ABSTRACT

The invention relates to an improved voltage control amplifier of the type comprising a gain cell. The gain cell is of the type that includes at least one log transistor for each polarity of input signal and at least one antilog transistor for each log transistor, means for algebraically summing a control signal with the log signal provided by each log transistor and means for providing a symmetry adjust signal to the base of a selected transistor of the cell so that the cell provides substantially the same gain for each polarity of input signal when the control signal level is set for zero. The improvement comprises means for generating a correction signal as a function of the control signal level so as to substantially correct for differences between the early effects exhibited by said transistors as said control signal varies and means for applying the correction signal to the base of one the transistors.

7 Claims, 3 Drawing Figures

MULTIPLIER CIRCUIT

The present invention relates generally to analog signal multipliers or gain control systems, and more particularly, to voltage controlled amplifiers in which compensation is provided for substantially correcting for errors due to the Early effect.

Many systems, especially those processing audio and video signals, include signal gain control circuits controlled in response to an electrical command or control signal. One type of signal gain control circuit which has been commercially successful includes the multiplier circuit of the type described and claimed in U.S. Pat. No. 3,714,462 issued to David E. Blackmer on Jan. 30, 1973, as well as those manufactured and licensed by DBX, Inc., a corporation of Massachusetts (the circuits being collectively hereinafter referred to as the "DBX Multiplier Circuit"). The DBX Multiplier Circuit generally includes means for providing a first signal as a function of the logarithm of the input signal to the circuit and means for algebraically summing a control signal to the first signal. The signal gain is a function of the level of the control signal. The circuit also includes means for providing an output signal as a function of the antilogarithm of the algebraic sum of the first and control signals. The DBX Multiplier Circuit is "bipolar" meaning that the input signal can be of either or both positive and negative polarities. The "gain" provided by the circuit can be either amplification or attenuation.

The preferred DBX multiplier circuit includes an operational amplifier and a gain cell. The gain cell includes at least two transistors, each exhibiting a log-linear base-emitter voltage/collector current (Vbe/Ic) transfer characteristic, respectively connected in oppositely conductive feedback paths of the amplifier. The two transistors respectively provide the log voltage signals in response to input current signals of positive and negative polarities. The gain cell also includes at least two other transistors, also exhibiting log-linear Vbe/Ic transfer characteristics, respectively connected to the log signal converting transistors. These two other transistors respectively provide output signals as a function of the antilogarithm of the algebraic sum of the log and control voltage signals. The gain of the transistors is preferably controllable in accordance with a control voltage applied to the bases of selected ones of the transistors.

The preferred gain cell of the DBX Multiplier Circuit utilizes at least two transistors of a PNP conductivity type for one polarity of input signal and at least two transistors of an NPN conductivity type for the opposite polarity input signals. While every effort is made to match the NPN transistors and the PNP transistors for their respective Vbe/Ic transfer characteristics (which includes their semiconductor areas), typically the transistors are not so perfectly matched, even when the circuit is manufactured in accordance with IC techniques. For example, if one transistor has an area different from the area of the remaining transistors, for a given control signal the cell will provide a signal gain for an input signal level of one polarity that differs from the signal gain for that input signal level of the opposite polarity. This results in signal distortion.

In addition to distortion, an offset problem exists wherein the gain cell will provide an output error signal. For example, where the area of one of the antilog transistors is 99% of the area of the remaining transistors, for unity gain the collector current of the smaller area antilog transistor will be 99% of the collector current of the other antilog transistor resulting in an 0.01 output error. This problem will remain for gain settings other than unity.

Accordingly, as taught in U.S. Pat. No. 3,714,462 a symmetry adjust voltage can be added to the base of one of the transistors so that for a given level of control signal the gain provided by the cell for input signals of one polarity matches the gain provided by the cell for input signals of opposite polarity. Typically, the symmetry adjust voltage is provided by a potentiometer which is adjusted with the gain of the cell set for unity gain (i.e., the control voltage is zero). While the cell will then function as though all of the transistors are substantially matched, as the gain changes from unity gain the distortion and offset problems will appear due to the Early effect.

In particular, in a transistor the ideal relationship of Ic to Vbe is as follows:

$$Ic = Is\,[\exp(Vbe/Vt) - 1] \qquad (1)$$

wherein Ic is the collector current of the transistor;

Is is the reverse saturation current of the transistor;

exp indicates the natural exponential function;

Vbe is the voltage across the base emitter junction of the transistor; and

Vt is the thermal voltage which is a function of operating temperature.

Although this equation would seem to indicate that the collector current Ic is independent of the voltage between the collector and base of the transistor, i.e., Vcb, in reality it is not. While such an ideal relationship would exist if the transistor had infinite output impedance (i.e., Ic is constant for all values of Vcb), in fact Ic will typically increase as Vcb increases. In the DBX Multiplier Circuit the greater the rate of increase of Ic with increases of Vcb, the poorer the performance of the transistor.

This increase of the collector current with increases in the collector-base voltage is called the Early effect. The latter is due to the fact that as the voltage across the base-collector junction increases, the width of the junction increases, resulting in a narrowing of the base region. This in turn creates a greater slope in the carrer distribution in the base region, increasing the collector current. For an explanation of the Early effect see for example, Milnes, A. G.; *Semiconductor Devices and Integrated Electronics;;* Van Nostrand Reinhold Company, New York; 1980; page 205). As a result of this change in the base region, one is essentially changing the value of the saturation current Is, of equation (1). When matching transistors in a gain cell, one is effectively matching the saturation currents of the transistors.

A change in the Is of a transistor within the gain cell of the DBX Multiplier Circuit potentially can cause an inbalance in the gain cell. If the transistors of the gain cell of the DBX Multiplier Circuit, however, all exhibit the same Early effect, i.e. the collector current of each transistor varies as a function of the collector base voltage in a substantially identical manner, there is no problem. Since the symmetry adjust voltage provides matched gain of the cell for positive and negative input signals when the cell operates at unity gain, the gain will remain matched for positive and negative input signals with changes in control voltage due to the identical performance of the transistors of the gain cell. However, in reality different transistors, and in particular, transistors of opposite conductivity types (NPN and PNP) frequently exhibit different Early effects. Therefore, when the control signal is added to one NPN transistor and one PNP transistor of a gain cell, an inbalance in the cell can occur. As a result distortion and offset can be generated by the gain cell as the gain varies from unity gain.

It is therefore a general object of the present invention to provide an improved multiplier circuit which overcomes or substantially reduces the foregoing problems of the prior art.

Another object of the present invention is to provide an improved multiplier circuit of the type including a gain cell in which distortion and offset due to the Early effect of the transistors of the gain cell remain substantially at zero with changes in the level of the control voltage.

These and other objects of the present invention are achieved by an improved multiplier circuit of the type including a gain cell. The improvement comprises means for generating a compensating signal as a function of the control signal, and applying the compensating signal to the base of a selected transistor of the cell to substantially correct for variations in the Early effect exhibited by the transistors of the cell responsively to changes in the level of the control signal.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawing wherein.

Figure 1:
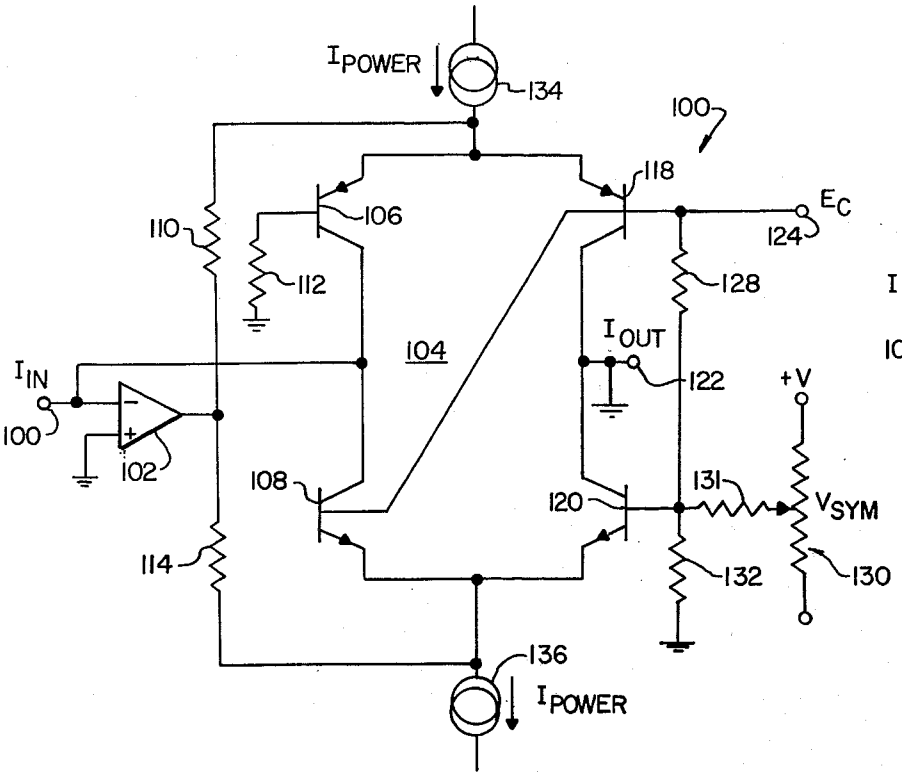
FIG. 1 is a circuit schematic of a multiplier circuit including a four transistor gain cell incorporating the preferred embodiment of the present invention.

In FIG. 1, the multiplier circuit shown includes an input terminal 100 for receiving an input current signal of either or both polarities. Input terminal 100 is connected to the inverting input of operational amplifier 102, the latter having its non-inverting input connected to system ground and its output connected to its inverting input through two feedback paths, one for each polarity of input signal. The feedback paths respectively include the base-emitter junctions of two log transistors 106 and 108 of the four transistor gain cell 104. In particular, the output of amplifier 102 is connected through resistor 110 to the emitter of PNP log transistor 106, the latter having its base connected through resistor 112 to system ground and its collector connected directly to the inverting input of amplifier 102. In a similar manner the output of amplifier 102 is connected through resistor 114 to the emitter of NPN log transistor 108, and its collector connected to the inverting input of amplifier 102. PNP log transistor 106 has its emitter connected to the emitter of the PNP antilog transistor 118, while NPN log transistor has its emitter connected to the emitter of NPN antilog transistor 120. The collectors of antilog transistors 118 and 120 are tied together to form the output terminal 122 of the cell 104, as well as the output terminal of the circuit. Terminal 122 is connected to a low impedance point such as virtual ground. Log transistor 106 and antilog transistor 118 thus form one signal processing path for one polarity of input signal, while log transistor 108 and antilog transistor 120 form a second signal processing path for the other polarity of input signal. In order to algebraically sum the control signal to the log signal provided by either log transistor 106 or 108, the control signal terminal 124, adapted to receive the control signal, is connected to the bases of antilog transistor 118 and log transistor 108, with the base of transistor 118 being connected to resistor 128. Where mismatches occur between transistors 106 and 118, and transistors 108 and 120, gain symmetry is provided by connecting the adjustable potentiometer 130 through resistor 131 to the base of transistor 120, the latter being connected to system ground through resistor 132. Finally, the cell 104 is biased with a bias current by connecting the common emitters of PNP transistors 106 and 118 to a source 134 of current and by connecting the common emitters of NPN transistors 108 and 120 to a source 136 of current.

By connecting the base of transistor 106 directly to system ground, and deleting resistor 128 the system is the same as the type described in U.S. Pat. No. 3,714,462. However, by setting the potentiometer 130 so as to substantially reduce or eliminate distortion and offset at unity gain (when the control voltage at terminal 124 is zero), as the absolute value of the amplitude of the control signal increases (so that the gain changes from unity gain) the distortion and off-set can increase due to the different Early effects which the transistors 108 and 118 may exhibit.

In accordance with the present invention means are provided for providing a correction signal applied to the base of transistor 120 as a function of the control voltage so as to correct for the differences in Early effects exhibited by transistors 106, 108, 118 and 120. The precise relationship of the difference in Early effects as a function of the control voltage can be approximated by the linear function:

$$V_{correction} = K \cdot V_{control} \quad (2)$$

wherein K is a constant. As a consequence in the preferred embodiment of the present invention resistor 128 is connected directly between the base of transistor 118 and the base of transistor 120. Resistors 128 and 132 thus function as a voltage divider, whereby typical resistance values of resistor 132 and resistor 128 are 200 kilohms and 50 ohms, respectively, providing a divider of approximately 4000, although these values can vary. Thus, in the example given where the value of $V_{sym}$ is initially set by potentiometer 130 for unity gain ($E_c=0$), a correction signal is added to the symmetry adjust signal on the base of transistor 120 which is approximately equal to 1/4000 of the value of the control voltage $E_c$ to correct for differences in the Early effects of the transistors.

Figure 2:
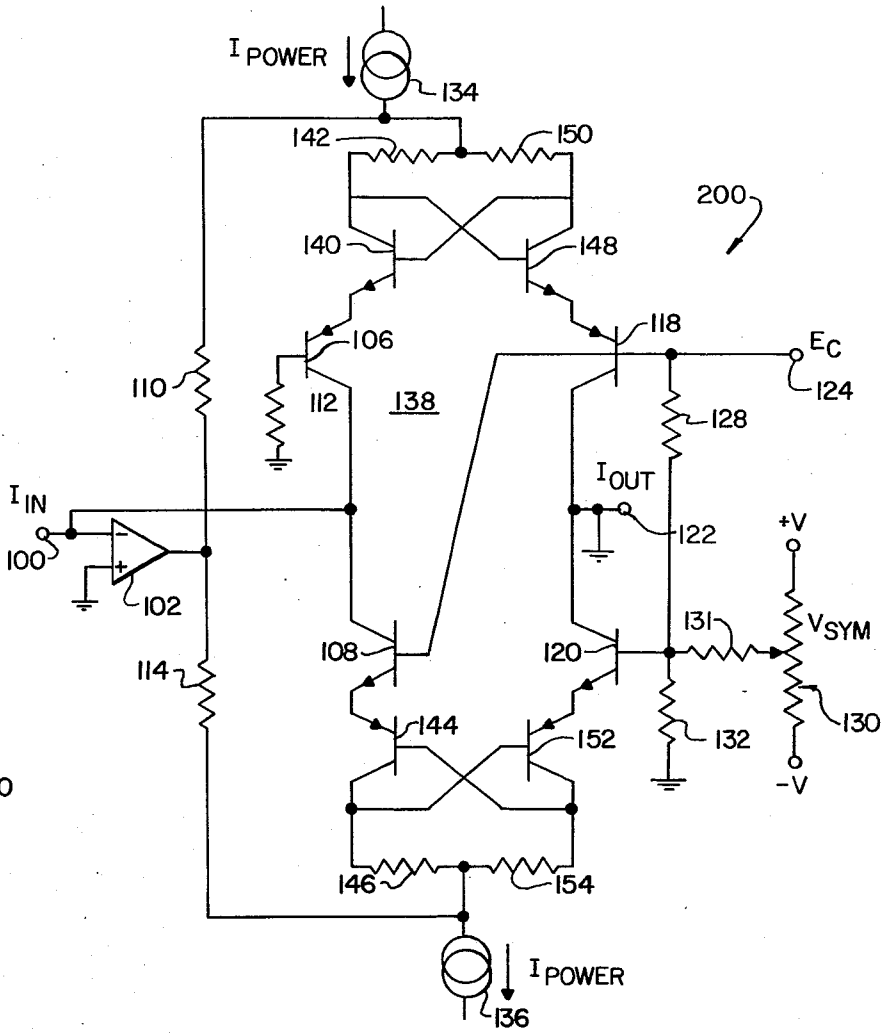
FIG. 2 is a circuit schematic of a multiplier circuit including an eight transistor gain cell incorporating the preferred embodiment of the present invention.
Figure 3:
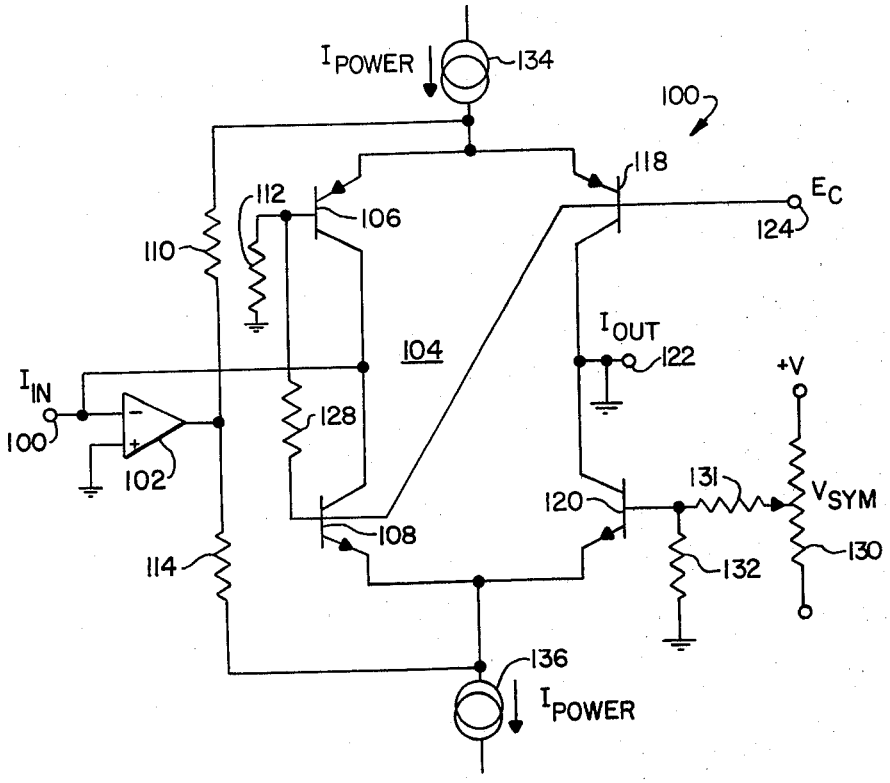
FIG. 3 is a circuit schematic of a multiplier circuit having a four transistor gain cell showing a modification to the circuit of FIG. 1.

While the configuration shown in FIG. 1 is satisfactory when transistor 118 exhibits a greater Early effect than that of transistor 108, where the converse is true, resistor 128 would be connected between the common bases of transistors 108 and 118 and the base of transistor 106 as illustrated in FIG. 3. Resistors 128 and 112 would then form the resistor divider for defining the constant K, of equation (2) and the correction signal would be added to the base of transistor 106. Further, although the invention has been described with respect to four transistor gain cell 104, it also can easily be applied to other gain cells such as the eight transistor gain cell 138 shown in FIG. 2.

In FIG. 2, each feedback path of amplifier 102 is provided with a pair of log transistors, and similarly each antilog path is provided with a pair of antilog transistors. In particular, a NPN log transistor 140 has its emitter connected to the emitter of log transistor 106 and its collector connected through resistor 142 and resistor 110 to the output of amplifier 102. Similarly, a PNP log transistor 144 has its emitter connected to the emitter of transistor 108 and its collector connected through resistors 146 and 114 to the output of amplifier 102. An additional NPN antilog transistor 148 has its emitter connected to the emitter of transistor 118 and its collector connected through resistor 150 to the junction of resistors 142 and 110. Similarly, an additional NPN antilog transistor 152 has its emitter connected to the emitter of transistor 120 and its collector connected through resistor 154 to the junction of resistors 146 and 114.

The additional NPN log and antilog transistors 140 and 148, each has its base coupled to the collector of the other. Similarly, the additional PNP log and antilog transistors 144 and 152, each has its base coupled to the collector of the other. As shown the control voltage is added to the bases of transistors 108 and 118 in the same manner as shown in FIG. 1. Similarly, the symmetry adjust voltage (although differing with respect to the fact that it corrects for mismatches between the four transistor 106, 140, 148 and 118 and the four transistors 108, 144, 152 and 120) is applied to the base of transistor 120 as in FIG. 1. Finally, the Early effect correction signal is applied to the base of transistor 120 in an identical manner.

By adding a correction signal as a function of the control signal, distortion and offset problems created by the differences in Early effects of the transistors 108 and 118 of the gain cells 104 and 138 can be substantially reduced or eliminated. Since the relationship between the correction signal and the control signal is approximately linear, this is easily accomplished by connecting the linear resistor 128 between the base of the transistor 120 receiving the symmetry adjust signal and the base of the transistor 118 receiving the control signal, or alternatively as described above by connecting the base of transistor 106 and the base of the transistor 118 receiving the control signal.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a signal multiplier of the type comprising an operational amplifier and a gain cell connected to said amplifier, said gain cell having an input terminal for receiving an input signal and a control signal terminal for receiving a control signal, said gain cell comprising two signal processing paths respectively for the positive and negative portions of said input signal, and means for coupling said control terminal to each of said paths, each of said paths including (a) at least one first transistor for providing a log signal as a logarithmic function of the corresponding portion of the input signal and (b) a corresponding at least one second transistor coupled to said first transistor for providing an antilog signal as an antilogarithmic function of the algebraic sum of said log signal and said control signal, the improvement comprising means coupled to said control terminal for generating a correction signal as a function of said control signal so as to substantially correct for differences between the Early effects exhibited by said transistors of each path as said control signal varies and for applying said correction signal to the base of one of said transistors.

2. A signal multiplier according to claim 1, wherein the amplitude level of said correction signal is substantially a linear function of the amplitude level of said control signal.

3. A signal multiplier according to claim 2, wherein said means for generating said correction signal includes a first resistor coupled between said control input terminal and the base of said one of said transistors.

4. A signal multiplier according to claim 3, further including a symmetry adjust terminal and means for coupling said symmetry adjust terminal to the base of said one of said transistors, wherein said first resistor is coupled between the base of said one of said transistors, and said control signal terminal.

5. A signal multiplier according to claim 4, wherein said means for coupling said symmetry adjust terminal includes a second resistor coupled between the base of said one of said transistors and system ground so that said first and second resistors function as a voltage divider for said control signal to generate said correction signal.

6. A signal multiplier according to claim 5, wherein the ratio of the resistance values of said second resistor to said first resistor is approximately 1:4000.

7. A signal multiplier according to claim 3, further including a symmetry adjust terminal and means for coupling said symmetry adjust terminal to the base of another one of said transistors.

* * * * *